US011933493B2

(12) United States Patent
Wu et al.

(10) Patent No.: US 11,933,493 B2
(45) **Date of Patent: *Mar. 19, 2024**

(54) TOOL WITH IMPROVED IGNITION EFFICIENCY

(71) Applicant: Pro-Iroda Industries, Inc., Taichung (TW)

(72) Inventors: Wei Cheng Wu, Taichung (TW); Cheng Nan Yang, Taichung (TW)

(73) Assignee: PRO-IRODA INDUSTRIES, INC., Taichung (TW)

( * ) Notice: Subject to any disclaimer, the term of this patent is extended or adjusted under 35 U.S.C. 154(b) by 423 days.

This patent is subject to a terminal disclaimer.

(21) Appl. No.: 17/182,463

(22) Filed: Feb. 23, 2021

(65) Prior Publication Data

US 2022/0235932 A1 Jul. 28, 2022

Related U.S. Application Data

(63) Continuation-in-part of application No. 17/155,377, filed on Jan. 22, 2021.

(51) Int. Cl.

| | |
|---|---|
| ***F23D 14/28*** | (2006.01) |
| ***F23D 14/52*** | (2006.01) |
| ***F23Q 2/28*** | (2006.01) |

(52) U.S. Cl.

CPC ..... *F23D 14/28* (2013.01); *F23D 14/52* (2013.01); *F23Q 2/28* (2013.01); *F23D 2207/00* (2013.01)

(58) Field of Classification Search

CPC ..... F23D 14/28; F23D 14/52; F23D 2207/00; F23Q 2/28; F23Q 2/16; F23Q 3/006; F23Q 3/002

(Continued)

(56) References Cited

U.S. PATENT DOCUMENTS 2,921,239 A * 1/1960 Dryden ..... F23Q 3/006 313/131 R
3,051,862 A * 8/1962 Hoff ..... F23Q 3/006 313/146

(Continued)

FOREIGN PATENT DOCUMENTS

CN 201327056 Y 10/2009
CN 207112866 U 3/2018

(Continued)

OTHER PUBLICATIONS

"TW_M406154_U_I—Machine Translation.pdf", Machine Translation, Clarivate Analytics, 2003. (Year: 2003).*

*Primary Examiner* — Steven B McAllister
*Assistant Examiner* — Daniel E. Namay
(74) *Attorney, Agent, or Firm* — Muncy, Geissler, Olds & Lowe, P.C.

(57) ABSTRACT

A tool includes a barrel, a guiding wire, and an electrically conductive member. The barrel is made of electrically conductive material. The guiding wire is disposed in the barrel. The barrel and the guiding wire are directly or indirectly connected to two opposite electrodes of a power source. The electrically conductive member is connected to an outer periphery of the guiding wire and is electrically connected to the guiding wire. The electrically conductive member is disposed between the barrel and the guiding wire and is spaced from the barrel. When the power source is activated, an electric arc is generated between the electrically conductive member and the barrel.

13 Claims, 9 Drawing Sheets

(58) Field of Classification Search
USPC ..... 431/142, 266, 128
IPC ..... F25D 14/28,14/52; F23Q 2/28, 2/16, F23Q 3/00
See application file for complete search history.

(56) References Cited

U.S. PATENT DOCUMENTS

| | | | | | |
|---|---|---|---|---|---|
| 3,947,731 | A * | 3/1976 | Vainer | F23Q 3/002 | 431/255 |
| 4,337,029 | A * | 6/1982 | McElroy | F23Q 3/006 | 248/65 |
| 4,433,266 | A * | 2/1984 | Riehl | F23Q 9/00 | 313/135 |
| 4,717,986 | A * | 1/1988 | Collins, Jr. | F23Q 3/006 | 361/253 |
| 4,881,894 | A | 11/1989 | Chapin et al. | | |
| 4,954,078 | A | 9/1990 | Nelson | | |
| 6,190,161 | B1 | 2/2001 | Mandica et al. | | |
| 6,241,511 | B1 * | 6/2001 | Hsu | F23Q 2/287 | 431/255 |
| 6,336,807 | B1 * | 1/2002 | Hsu | F23Q 2/164 | 431/153 |
| 6,428,309 | B1 * | 8/2002 | Doiron | F23Q 2/287 | 431/153 |
| 9,182,144 | B2 * | 11/2015 | Chen | F23D 14/36 | |
| 2002/0055076 | A1 * | 5/2002 | Adams | F23Q 2/164 | 431/153 |
| 2002/0180313 | A1 * | 12/2002 | Orazietti | F23Q 3/002 | 310/339 |
| 2004/0081931 | A1 * | 4/2004 | Sgroi, Jr. | F23Q 2/164 | 431/153 |
| 2007/0077529 | A1 * | 4/2007 | Lin | F23D 14/28 | 431/241 |
| 2007/0160941 | A1 * | 7/2007 | Lin | F23Q 2/163 | 431/153 |
| 2008/0213712 | A1 * | 9/2008 | Huang | F23Q 2/164 | 431/153 |
| 2008/0220385 | A1 * | 9/2008 | Mochizuki | F23Q 2/16 | 431/153 |
| 2008/0220386 | A1 * | 9/2008 | Mochizuki | F23Q 2/16 | 431/253 |
| 2008/0241773 | A1 * | 10/2008 | Mochizuki | F23Q 2/164 | 431/153 |
| 2009/0004613 | A1 * | 1/2009 | Shan | F23Q 2/287 | 431/153 |
| 2010/0081101 | A1 * | 4/2010 | Shan | F23Q 2/164 | 431/253 |
| 2010/0190121 | A1 * | 7/2010 | Mochizuki | F23Q 2/164 | 431/153 |
| 2011/0217662 | A1 | 9/2011 | Zagoroff | | |
| 2014/0220499 | A1 * | 8/2014 | Buzinski | F23Q 3/006 | 431/6 |
| 2016/0258620 | A1 * | 9/2016 | Yang | F23D 14/38 | |
| 2019/0360692 | A1 * | 11/2019 | Luo | F23Q 2/16 | |
| 2022/0235932 | A1 * | 7/2022 | Wu | F23Q 2/28 | |

FOREIGN PATENT DOCUMENTS

| | | | | | |
|---|---|---|---|---|---|
| CN | 107013938 | B | | 8/2019 | |
| CN | 209655351 | U | | 11/2019 | |
| DE | 29907799 | U1 | | 8/1999 | |
| EP | 0273302 | A2 | * | 12/1987 | F23Q 2/287 |
| GB | 948655 | A | * | 5/1961 | F23Q 2/287 |
| GB | 2156499 | A | * | 10/1985 | F23Q 2/287 |
| JP | H09133359 | A | * | 11/1995 | F23D 14/48 |
| JP | 09133359 | A | * | 5/1997 | F23D 14/28 |
| JP | 2007064605 | A | * | 3/2007 | F23Q 2/16 |
| TW | 317328 | U | | 10/1997 | |
| TW | M279814 | U | | 11/2005 | |
| TW | M406154 | U | | 6/2011 | |
| TW | I436006 | B | | 5/2014 | |
| TW | I495830 | B | | 8/2015 | |
| WO | WO-2008146369 | A1 | * | 12/2008 | B60L 7/18 |

* cited by examiner

TOOL WITH IMPROVED IGNITION EFFICIENCY

CROSS-REFERENCE

The present application is a continuation-in-part application of U.S. patent application Ser. No. 17/155,377, filed on Jan. 22, 2021, now pending, of which the entire disclosure is incorporated herein by reference for all purposes.

BACKGROUND OF THE INVENTION

The present invention relates to a tool and, more particularly, to a tool with improved ignition efficiency.

Taiwan Utility Model No. M406154 discloses a lighter and its ignition structure. The lighter includes an insulating container receiving a flammable gas, a metal barrel, a gas guiding tube, and the ignition structure. The flammable gas flows from an interior of the insulating container through the gas guiding tube to the metal barrel. A distal end of the gas guiding tube has an electrically conductive sleeve in electrical connection with the metal barrel. The ignition structure includes an igniter and first and second ignition wires electrically connected to the igniter. The first ignition wire extends through the gas guiding tube and is electrically connected to the electrically conductive sleeve. The second ignition wire is disposed between the gas guiding tube and the metal barrel and is electrically connected to the metal barrel. When the igniter is pressed, the first and second ignition wires generate an electric arc at an opening of the metal barrel to ignite the flammable gas.

However, the inner diameter of the opening of the metal barrel affects the spacing between the first and second ignition wires and the flow of the gas. The spacing between the first and second ignition wires affects generation of the electric arc. When the inner diameter of the opening of the metal barrel is small, the flow of the gas is small. When the inner diameter of the opening of the metal barrel is small, generation of the electric are is difficult, and the service life of the igniter is shortened.

In view of the above, a need exists for a tool with improved ignition efficiency that mitigates and/or obviates the above drawbacks.

BRIEF SUMMARY OF THE INVENTION

An objective of the present invention is to provide a tool with improved ignition efficiency. The tool includes a barrel, a guiding wire, and an electrically conductive member. The barrel is made of electrically conductive material. The guiding wire is disposed in the barrel. The barrel and the guiding wire are directly or indirectly connected to two opposite electrodes of a power source. The electrically conductive member is connected to an outer periphery of the guiding wire and is electrically connected to the guiding wire. The electrically conductive member is disposed between the barrel and the guiding wire and is spaced from the barrel. When the power source is activated, an electric arc is generated between the electrically conductive member and the barrel. According to the above structure, the tool can improve the ignition efficiency to stably accomplish the ignition.

In an example, the electrically conductive member is made of electrically conductive rubber.

In an example, the electrically conductive member is annular and surrounds the guiding wire.

In an example, a first edge of the electrically conductive member adjacent to the guiding wire is provided with an inner periphery in contact with the guiding wire, and a second edge of the electrically conductive member opposite to the guiding wire is provided with an outer periphery with a circular cross-sectional shape in a radial direction of the guiding wire.

In another example, a first edge of the electrically conductive member adjacent to the guiding wire is provided with an inner periphery in contact with the guiding wire, and a second edge of the electrically conductive member opposite to the guiding wire is provided with an outer periphery with an oval cross-sectional shape in a radial direction of the guiding wire.

In yet another example, a first edge of the electrically conductive member adjacent to the guiding wire is provided with an inner periphery in contact with the guiding wire, and a second edge of the electrically conductive member opposite to the guiding wire is provided with an outer periphery with a triangular cross-sectional shape in a radial direction of the guiding wire.

In yet another example, a first edge of the electrically conductive member adjacent to the guiding wire is provided with an inner periphery in contact with the guiding wire, and a second edge of the electrically conductive member opposite to the guiding wire is provided with an outer periphery with a quadrangular cross-sectional shape in a radial direction of the guiding wire.

In yet another example, a first edge of the electrically conductive member adjacent to the guiding wire is provided with an inner periphery in contact with the guiding wire, and a second edge of the electrically conductive member opposite to the guiding wire is provided with an outer periphery with a hexagonal cross-sectional shape in a radial direction of the guiding wire.

In an example, the guiding wire includes a first end and a second end opposite to the first end. A first insulating layer and a second insulating layer are disposed around the outer periphery of the guiding wire. The electrically conductive member is disposed between the first insulating layer and the second insulating layer. The first insulating layer is disposed between the electrically conductive member and the first end of the guiding wire. The second insulating layer is disposed between the electrically conductive member and the second end of the guiding wire.

In an example, a fixing seat is disposed in the barrel. A sheath is disposed on the first end of the guiding wire. The sheath is disposed around the first insulating layer and is connected to the fixing seat.

In an example, the barrel includes a front barrel and a rear barrel. The fixing seat is disposed on an inner periphery of the front barrel. The rear barrel is connected to the front barrel and is made of electrically conductive material. The electrically conductive member is contiguous to an end of the rear barrel adjacent to the front barrel.

In an example, the tool includes a body. The power source is received in the body. An end of the rear barrel opposite to the front barrel is received in the body. The rear barrel includes a side hole extending in a radial direction of the rear barrel and is located in the body. The guiding wire extends through the side hole. The second end of the guiding wire is located outside of the barrel and is located in the body.

In an example, the power source is a piezoelectric igniter.

In an example, the guiding wire is flexible and is shapeable.

The present invention will become clearer in light of the following detailed description of illustrative embodiments of this invention described in connection with the drawings.

DETAILED DESCRIPTION OF THE INVENTION

Figure 1:
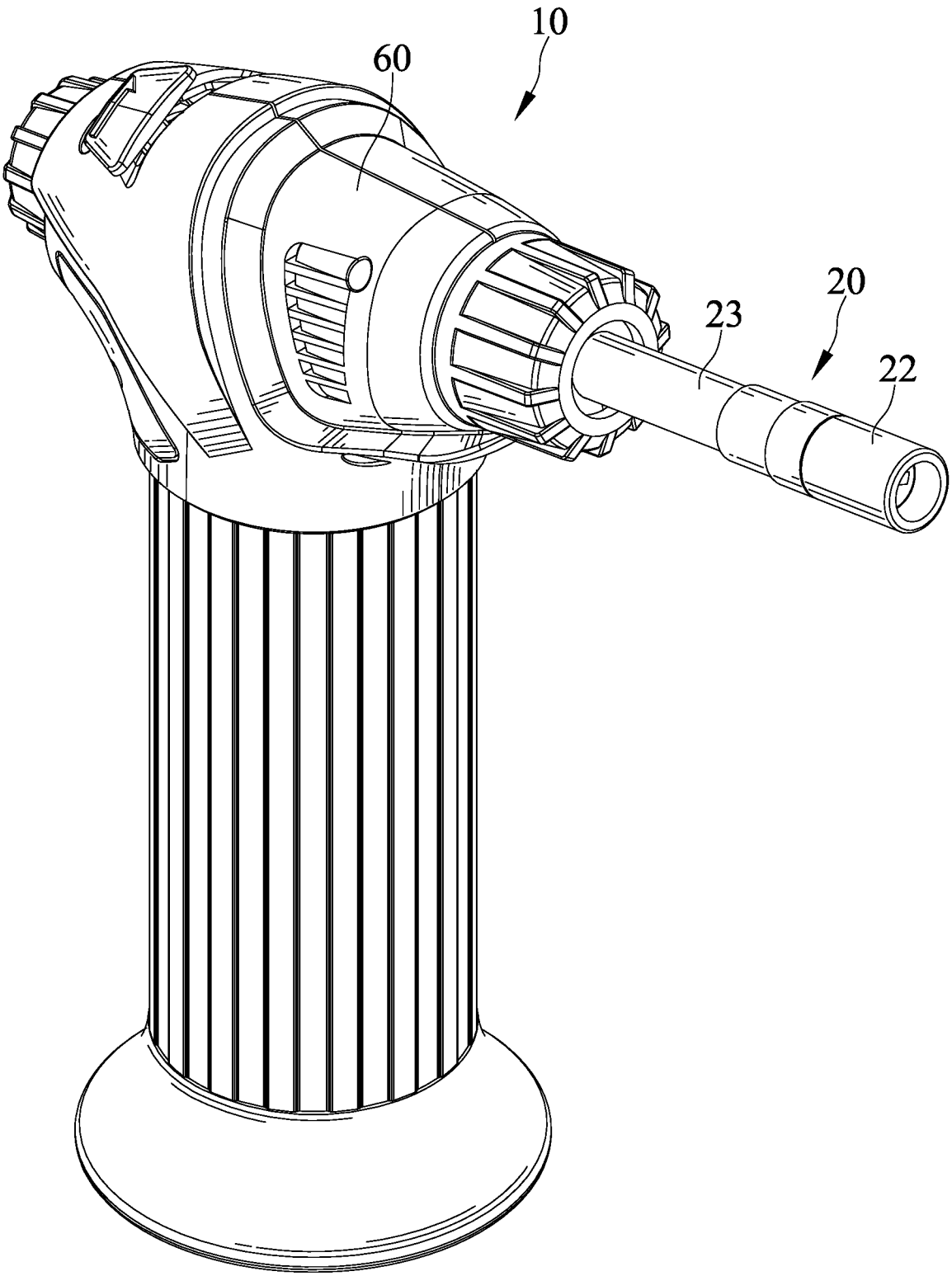
FIG. 1 is a perspective view of a tool with improved efficiency of a first embodiment according to the present invention.
Figure 2:
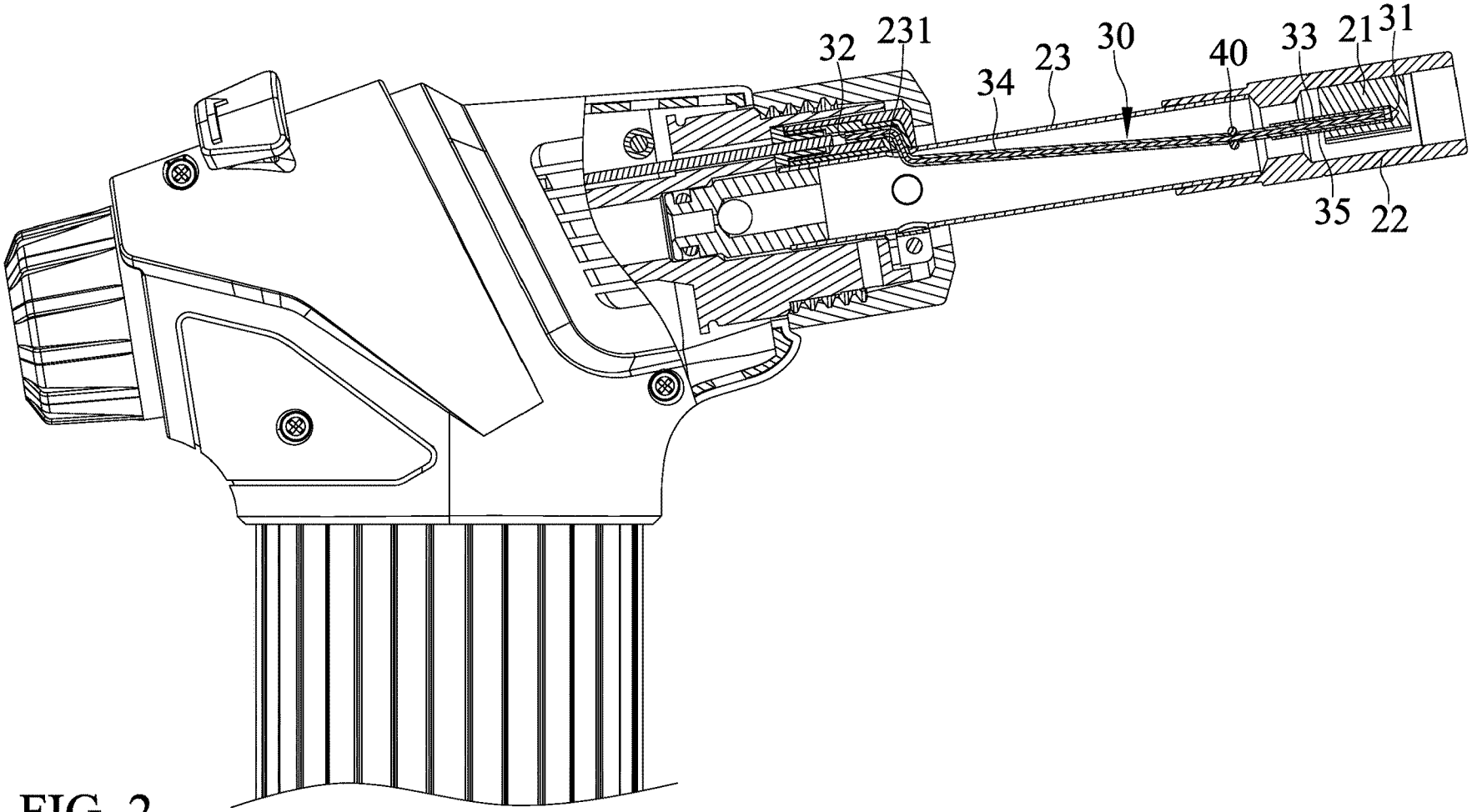
FIG. 2 is a partly cross-sectioned view of the tool of FIG. 1.
Figure 3:
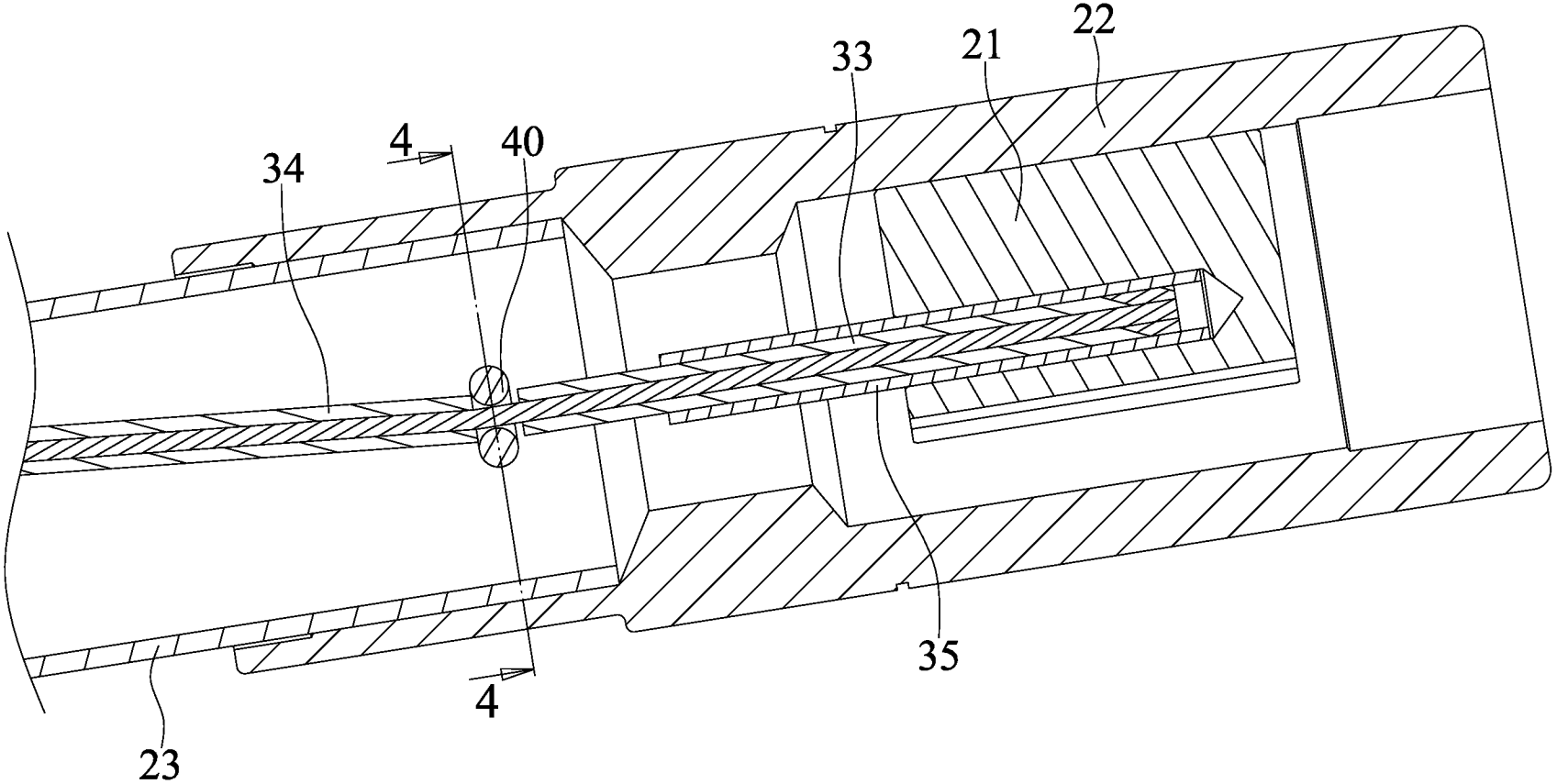
FIG. 3 is an enlarged view of a portion of the tool of FIG. 2.
Figure 4:
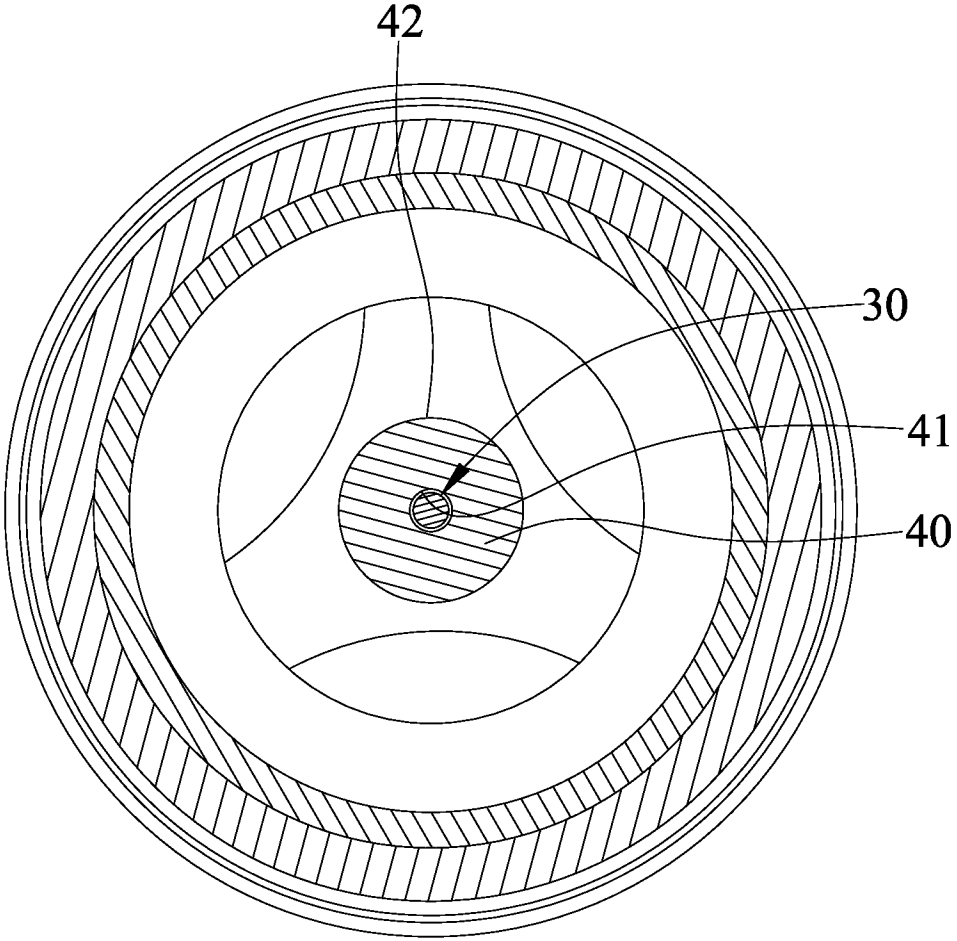
FIG. 4 is a cross-sectional view taken along line 4-4 of FIG. 3 and shows a cross-sectional structure of an electrically conductive member.
Figure 5:
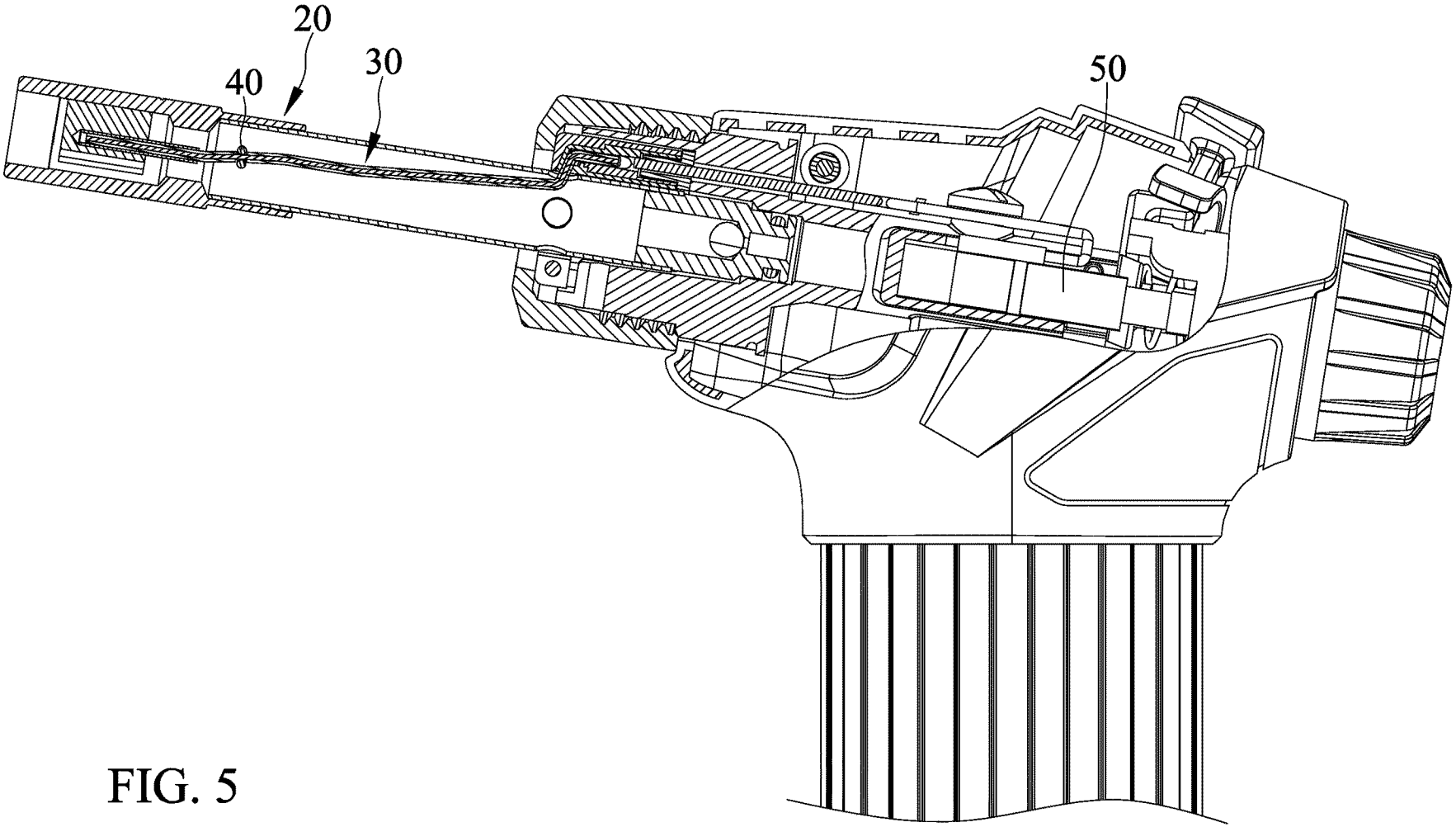
FIG. 5 is another partly cross-sectioned view of the tool of FIG. 1.

With reference to FIGS. 1-5, a tool 10 with improved efficiency of an embodiment according to the present invention comprises a barrel 20, a guiding wire 30, and an electrically conductive member 40. The barrel 20 is made of electrically conductive material. The guiding wire 30 is disposed in the barrel 20. The barrel 20 and the guiding wire 30 are directly or indirectly connected to two opposite electrodes of a power source 50.

The electrically conductive member 40 is connected to an outer periphery of the guiding wire 30 and is electrically connected to the guiding wire 30. The electrically conductive member 40 is disposed between the barrel 20 and the guiding wire 30 and is spaced from the barrel 20. When the power source 50 is activated, an electric arc is generated between the electrically conductive member 40 and the barrel 20.

The electrically conductive member 40 is made of electrically conductive material, such as copper, aluminum, graphite, etc. In this embodiment, the electrically conductive member 40 is made of electrically conductive rubber. The electrically conductive member 40 is annular and surrounds the guiding wire 30.

A first edge of the electrically conductive member 40 adjacent to the guiding wire 30 is provided with an inner periphery 41 in contact with the guiding wire 30. The inner periphery 41 has a circular cross-sectional shape in a radial direction of the guiding wire 30. A second edge of the electrically conductive member 40 opposite to the guiding wire 30 is provided with an outer periphery 42 with a circular cross-sectional shape in a radial direction of the guiding wire 30. Understandably, the outer periphery 42 may have a circular or non-circular cross-sectional shapes, the embodiment shows that the outer periphery 42 has an essentially circular cross-sectional shape.

The guiding wire 30 includes a first end 31 and a second end 32 opposite to the first end 31. A first insulating layer 33 and a second insulating layer 34 are disposed around the outer periphery of the guiding wire 30. The electrically conductive member 40 is disposed between the first insulating layer 33 and the second insulating layer 34. The first insulating layer 33 is disposed between the electrically conductive member 40 and the first end 31 of the guiding wire 30. The second insulating layer 34 is disposed between the electrically conductive member 40 and the second end 32 of the guiding wire 30.

A fixing seat 21 is disposed in the barrel 20. A sheath 35 is disposed on the first end 31 of the guiding wire 30. The sheath 35 is disposed around the first insulating layer 33 and is connected to the fixing seat 21.

The barrel 20 includes a front barrel 22 and a rear barrel 23. The fixing seat 21 is disposed on an inner periphery of the front barrel 22. The rear barrel 23 is connected to the front barrel 22 and is made of electrically conductive material. The electrically conductive member 40 is contiguous to an end of the rear barrel 23 adjacent to the front barrel 22.

The tool 10 includes a body 60 in which the power source 50 is received. An end of the rear barrel 23 opposite to the front barrel 22 is received in the body 60. The rear barrel 23 includes a side hole 231 extending in a radial direction of the rear barrel 23 and is located in the body 60. The guiding wire 30 extends through the side hole 231. The second end 32 of the guiding wire 30 is located outside of the barrel 20 and is located in the body 60.

In this embodiment, the power source 50 is a piezoelectric igniter. The guiding wire 30 is flexible and is shapeable.

According to the above structure, the tool 10 can improve the ignition efficiency to stably accomplish the ignition. In this embodiment, the tool 10 is a gas tool. Gas can flow through the barrel 20 and can be ignited by the electric arc between the electrically conductive member 40 and the barrel 20. Flame can be ejected from an end of the barrel 20 opposite to the body 60.

Since the electrically conductive member 40 is connected to the outer periphery of the guiding wire 30, the spacing between the electrically conductive material of the guiding wire 30 and the electrically conductive portion of the barrel 20 can be reduced. This reduces the puncture voltage required for the puncturing phenomenon between the barrel 20 and the electrically conductive member 40, thereby increasing the success possibility of generation of electric arc between the barrel 20 and the electrically conductive member 40. After the power source 50 is activated, the electric arc is generated between the barrel 20 and the electrically conductive member 40. The electric charges emitted by the power source 50 circulate along a loop formed by the barrel 20, the guiding wire 30, and the electrically conductive member 40. Thus, the service life of the power source 50 is prolonged, and the number of times of electric fire provided by the power source 50 is increased.

By providing the flexible and shapeable guiding wire 30 cooperating with the annular electrically conductive member 40 that surrounds the guiding wire 30, the puncture voltage can be further reduced. A metal wire has certain flexibility and can maintain a fixed shape by tensioning. The location of the electrically conductive member 40 in the barrel 20 is so arranged that the guiding wire 30 in this embodiment can change its shape without being tensioned and that no matter how the guiding wire 30 changes its shape, the electrically conductive member 40 is more adjacent to the inner periphery of the barrel 20. Furthermore, the outer periphery of the electrically conductive member 40 is arcuate to present a small area most adjacent to the barrel 20. This further reduces the puncture voltage. As long as the guiding wire 30 has a proper length, the electrically conducive member 40 is always spaced from the barrel 20.

The first insulating layer 33 and the second insulating layer 34 can be formed by peeling a rubber sheath of the guiding wire 30 to form two sections. The electrically conductive member 40 made of electrically conductive rubber is resilient and can be stretched across the first insulating layer 33 or the second insulating layer 34. Finally, the electrically conductive member 40 is disposed between the first insulating layer 33 and the second insulating layer 34.

Figure 6:
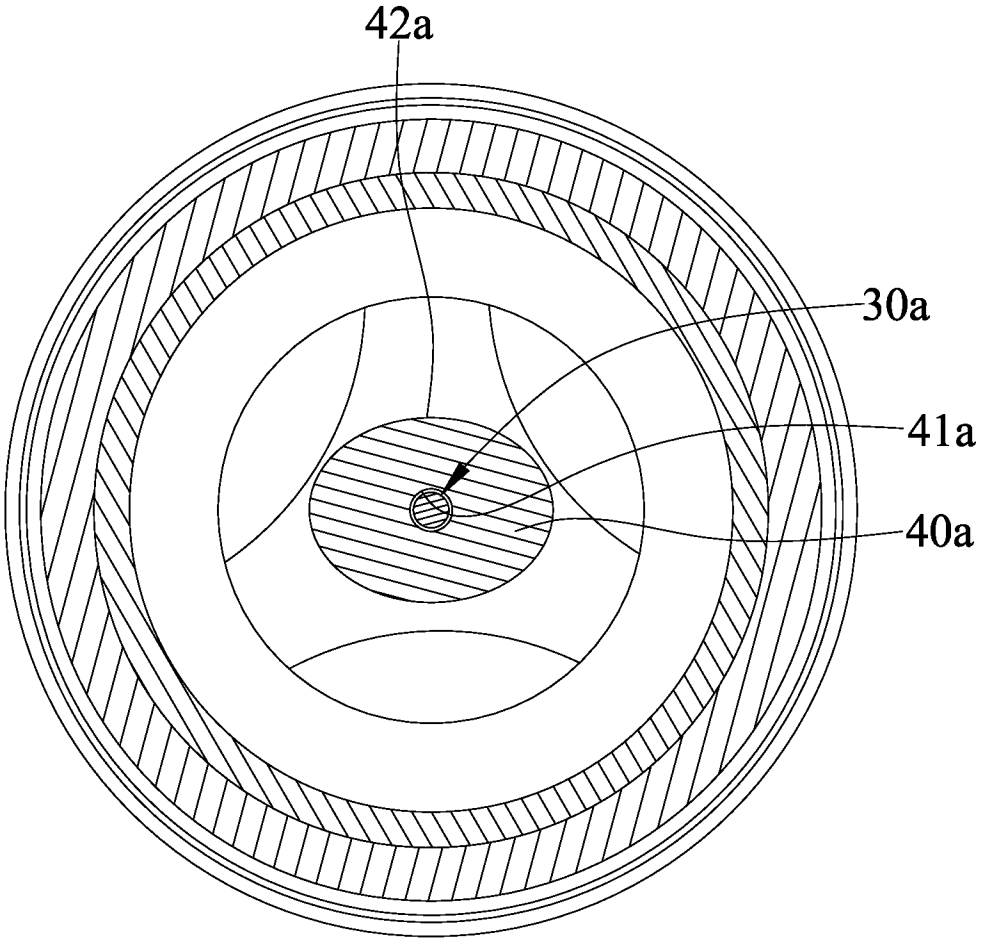
FIG. 6 is a cross-sectional view of a tool with improved efficiency of a second embodiment according to the present invention.

FIG. 6 shows a tool with improved efficiency of a second embodiment according to the present invention. The structure of the tool of this embodiment is substantially the same as that of the first embodiment except the following differences. Specifically, a first edge of the electrically conductive member 40*a* adjacent to the guiding wire 30*a* is provided with an inner periphery 41*a* in contact with the guiding wire 30*a*, and a second edge of the electrically conductive member 40*a* opposite to the guiding wire 30*a* is provided with an outer periphery 42*a* with an oval cross-sectional shape in a radial direction of the guiding wire 30*a*.

Figure 7:
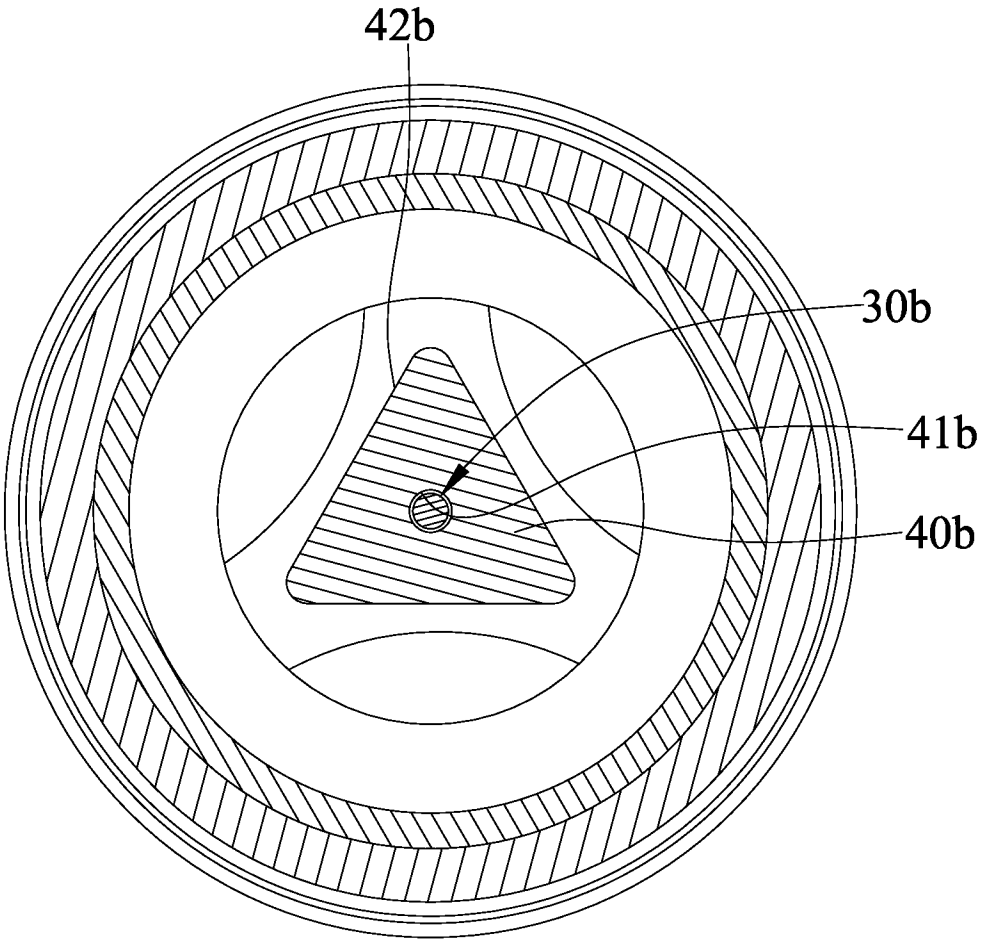
FIG. 7 is a cross-sectional view of a tool with improved efficiency of a third embodiment according to the present invention.

FIG. 7 shows a tool with improved efficiency of a third embodiment according to the present invention. The structure of the tool of this embodiment is substantially the same as that of the first embodiment except the following differences. Specifically, a first edge of the electrically conductive member 40*b* adjacent to the guiding wire 30*b* is provided with an inner periphery 41*b* in contact with the guiding wire 30*b*, and a second edge of the electrically conductive member 40*b* opposite to the guiding wire 30*b* is provided with an outer periphery 42*b* with a triangular cross-sectional shape in a radial direction of the guiding wire 30*b*.

Figure 8:
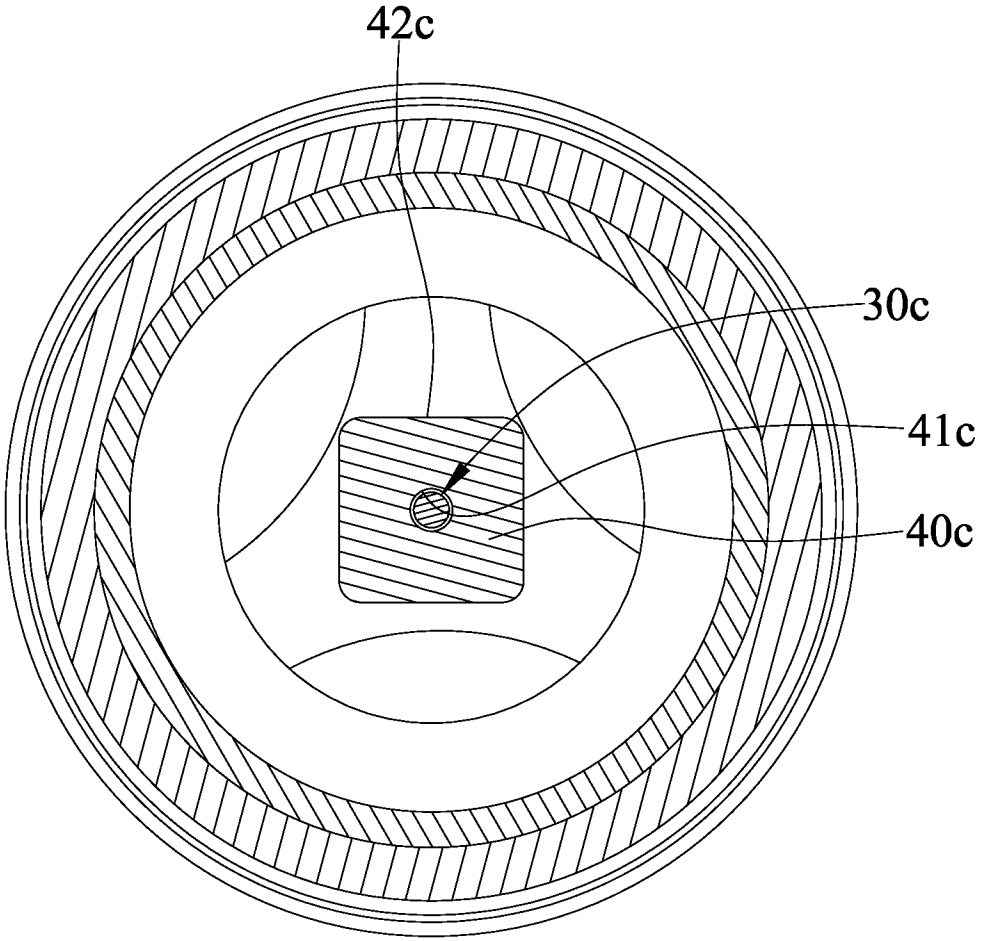
FIG. 8 is a cross-sectional view of a tool with improved efficiency of a fourth embodiment according to the present invention.

FIG. 8 shows a tool with improved efficiency of a fourth embodiment according to the present invention. The structure of the tool of this embodiment is substantially the same as that of the first embodiment except the following differences. Specifically, a first edge of the electrically conductive member 40*c* adjacent to the guiding wire 30*c* is provided with an inner periphery 41*c* in contact with the guiding wire 30*c*, and a second edge of the electrically conductive member 40*c* opposite to the guiding wire 30*c* is provided with an outer periphery 42*c* with a quadrangular cross-sectional shape in a radial direction of the guiding wire 30*c*.

Figure 9:
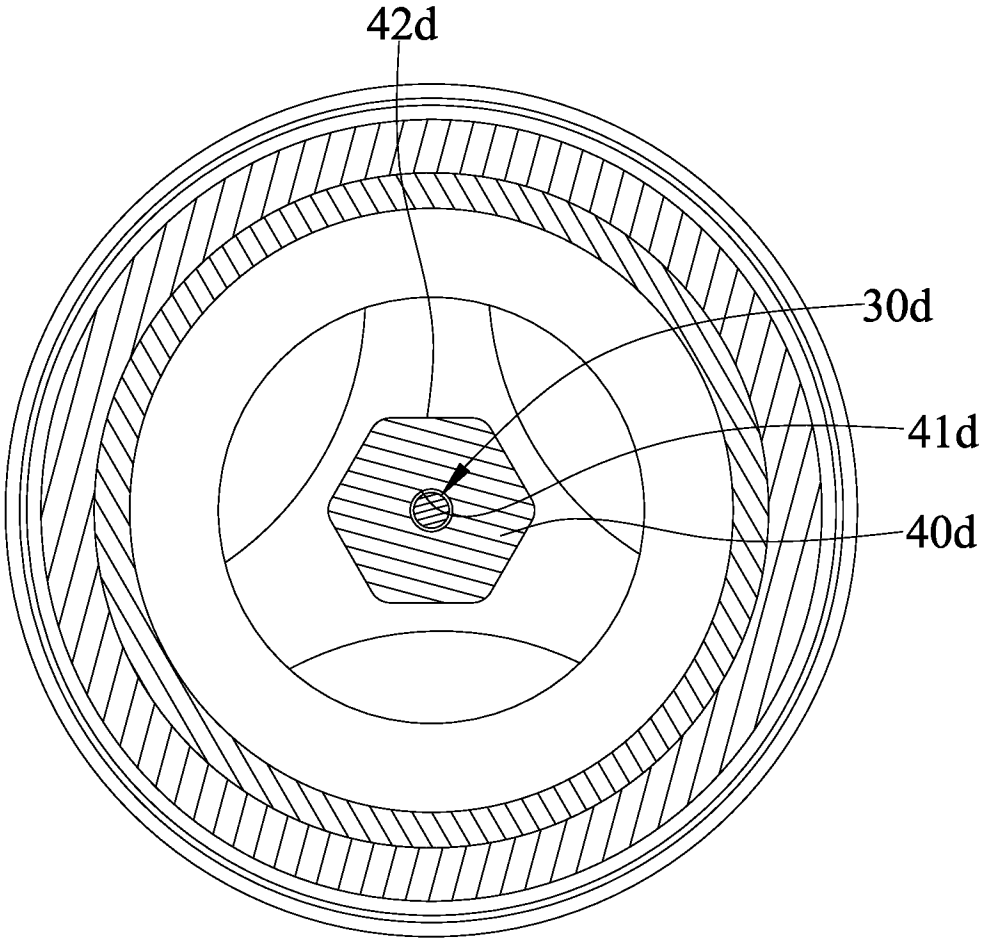
FIG. 9 is a cross-sectional view of a tool with improved efficiency of a fifth embodiment according to the present invention.

FIG. 9 shows a tool with improved efficiency of a fifth embodiment according to the present invention. The structure of the tool of this embodiment is substantially the same as that of the first embodiment except the following differences. Specifically, a first edge of the electrically conductive member 40*d* adjacent to the guiding wire 30*d* is provided with an inner periphery 41*d* in contact with the guiding wire 30*d*, and a second edge of the electrically conductive member 40*d* opposite to the guiding wire (30*d*) is provided with an outer periphery 42*d* with a hexagonal cross-sectional shape in a radial direction of the guiding wire 30*d*.

Although specific embodiments have been illustrated and described, numerous modifications and variations are still possible without departing from the scope of the invention. The scope of the invention is limited by the accompanying claims.

The invention claimed is:

1. A tool comprising:

a barrel made of electrically conductive material;

a guiding wire disposed in the barrel, wherein the barrel and the guiding wire are directly or indirectly connected to two opposite electrodes of a power source; and an electrically conductive member connected to an outer periphery of the guiding wire and electrically connected to the guiding wire, wherein the electrically conductive member is disposed between the barrel and the guiding wire and is spaced from the barrel, wherein when the power source is activated, an electric arc is generated between the electrically conductive member and the barrel, wherein the electrically conductive member is made of electrically conductive rubber and surrounds the guiding wire.

2. The tool as claimed in claim 1, wherein the electrically conductive member is annular.

3. The tool as claimed in claim 2, wherein a first edge of the electrically conductive member adjacent to the guiding wire is provided with an inner periphery in contact with the guiding wire, and wherein a second edge of the electrically conductive member opposite to the guiding wire is provided with an outer periphery with a circular cross-sectional shape in a radial direction of the guiding wire.

4. The tool as claimed in claim 2, wherein a first edge of the electrically conductive member adjacent to the guiding wire is provided with an inner periphery in contact with the guiding wire, and wherein a second edge of the electrically conductive member opposite to the guiding wire is provided with an outer periphery with an oval cross-sectional shape in a radial direction of the guiding wire.

5. The tool as claimed in claim 2, wherein a first edge of the electrically conductive member adjacent to the guiding wire is provided with an inner periphery in contact with the guiding wire, and wherein a second edge of the electrically conductive member opposite to the guiding wire is provided with an outer periphery with a triangular cross-sectional shape in a radial direction of the guiding wire.

6. The tool as claimed in claim 2, wherein a first edge of the electrically conductive member adjacent to the guiding wire is provided with an inner periphery in contact with the guiding wire, and wherein a second edge of the electrically conductive member opposite to the guiding wire is provided with an outer periphery with a quadrangular cross-sectional shape in a radial direction of the guiding wire.

7. The tool as claimed in claim 2, wherein a first edge of the electrically conductive member adjacent to the guiding wire is provided with an inner periphery in contact with the guiding wire, and wherein a second edge of the electrically conductive member opposite to the guiding wire is provided with an outer periphery with a hexagonal cross-sectional shape in a radial direction of the guiding wire.

8. The tool as claimed in claim 1, wherein the guiding wire includes a first end and a second end opposite to the first end, wherein a first insulating layer and a second insulating layer are disposed around the outer periphery of the guiding wire, wherein the electrically conductive member is disposed between the first insulating layer and the second insulating layer, wherein the first insulating layer is disposed between the electrically conductive member and the first end of the guiding wire, and wherein the second insulating layer is disposed between the electrically conductive member and the second end of the guiding wire.

9. The tool as claimed in claim 8, wherein a fixing seat is disposed in the barrel, wherein a sheath is disposed on the first end of the guiding wire, and wherein the sheath is disposed around the first insulating layer and is connected to the fixing seat.

10. The tool as claimed in claim 9, wherein the barrel includes a front barrel and a rear barrel, wherein the fixing seat is disposed on an inner periphery of the front barrel, wherein the real barrel is connected to the front barrel and is made of electrically conductive material, and wherein the electrically conductive member is contiguous to an end of the rear barrel adjacent to the front barrel.

11. The tool as claimed in claim 10, wherein the tool 10 includes a body, wherein the power source is received in the body, wherein an end of the rear barrel opposite to the front barrel is received in the body, wherein the rear barrel includes a side hole extending in a radial direction of the rear barrel and is located in the body, wherein the guiding wire extends through the side hole, and wherein the second end of the guiding wire is located outside of the barrel and is located in the body.

12. The tool as claimed in claim 11, wherein the power source is a piezoelectric igniter.

13. The tool as claimed in claim 11, wherein the guiding wire is flexible and is shapeable.

* * * * *